United States Patent [19]

Muhi et al.

[11] Patent Number: 4,483,622

[45] Date of Patent: Nov. 20, 1984

[54] DRINK IDENTIFYING MIXER

[76] Inventors: Charles Muhi, 25457 Via Escovar, Valencia, Calif. 91355; Peter Hamernik, 8239 Lankershin, Unit"A", North Hollywood, Calif. 91605; Miguel Szczecko, 19261 Calahan St., Northridge, Calif. 91324

[21] Appl. No.: 157,663

[22] Filed: Jun. 9, 1980

[51] Int. Cl.[3] ..... B01F 7/00

[52] U.S. Cl. ..... 366/129; D7/42; 40/2 R; 366/343

[58] Field of Search ..... 366/129, 130, 342, 343; D7/42, 51, 157, 160, 181, 184, 185; 40/2 R

[56] References Cited

U.S. PATENT DOCUMENTS

D. 149,499 5/1948 Holden ..... D7/42
2,370,931 3/1945 Bogin et al. ..... D7/42
2,723,111 11/1955 Lawrence ..... D7/42
3,772,809 11/1973 Schneller ..... D7/42

FOREIGN PATENT DOCUMENTS 1322928 2/1963 France ..... D7/42

*Primary Examiner*—Timothy F. Simone
*Attorney, Agent, or Firm*—Erik M. Arnhem

[57] ABSTRACT

A name identifying drink mixer, comprising an elongated flush member, its ends having broadening base and top portions, contoured to form decorative matching objects, the base portion functioning as a mixing implement, while the top portion thereof extends right-angularly rearward into a platelet for imprinting of a name thereon and terminates downwardly therefrom in two legs, disposed spatially apart, for attachment to the rim of a drinking glass.

4 Claims, 8 Drawing Figures

FIG.1
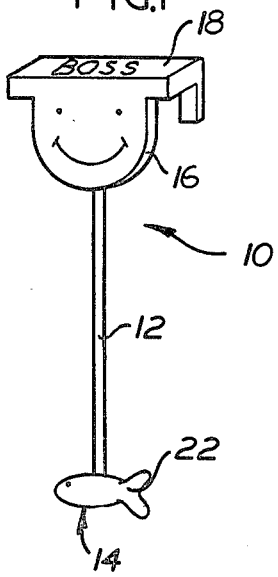
FIG.2
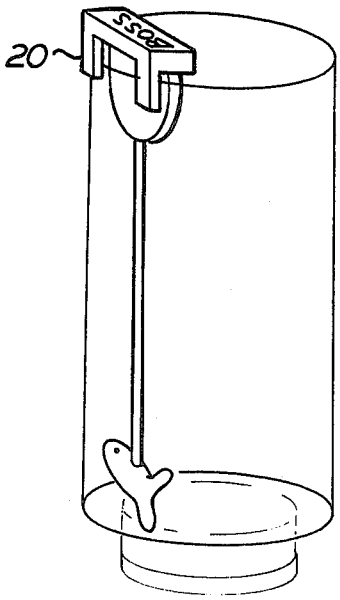
FIG.3
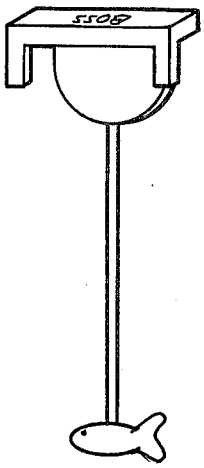
BOSS
FIG.4
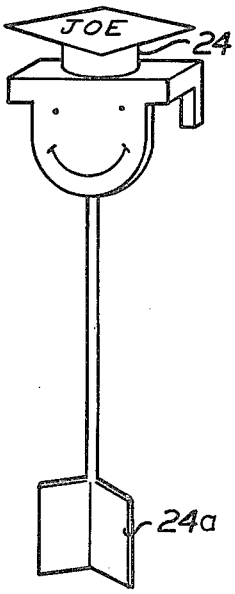
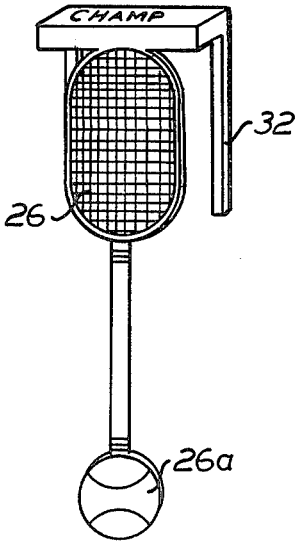
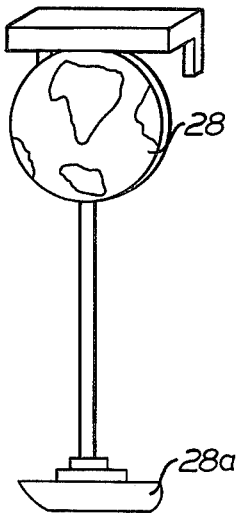
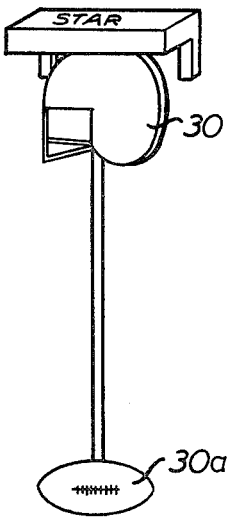
FIG.5A FIG.5B FIG.5C FIG.5D

DRINK IDENTIFYING MIXER

FIELD OF THE INVENTION (1) Background of the Invention

Our invention relates to a mixing or stirring device for drinks, such as coctails and the like. The device, according to the invention is primarily intended for use at social parties; its structure serves basically a threefold purpose, namely, to provide means for clearly identifying an individual participant at a party for whom a chosen drink is intended; to be attachable to the rim of a drinking glass so as to resist sliding movements there along; and to provide a more effective mixing of the drink.

(2) Description of the Prior Art

A preliminary patentability search revealed the following U.S. patents as being of particular interest with respect to our invention:

| | | |
|---|---|---|
| Petersen | 2.070.976 | 1937 |
| Sindler | 2.717.463 | 1955 |
| Lawrence | 2.723.111 | 1955 |
| Kucher | 2.925.087 | 1960 |
| Mauchline | 3.325.929 | 1967 |
| Schneller | 3.772.809 | 1973 |

Peterson refers to a fruit prong.

Sindler discloses a stirring implement, loosely placeable within a drink and having means for sliding insertion of a card.

Lawrence shows a beverage stirring implement, also loosely insertable in a drink, extending vertically therefrom at its top, into a platelet for various indicia.

Kucher is a combined toothpick and gum massager.

Mauchline is a tobacco sales ticket holder.

Schneller discloses an elongated member usable as a pick, stirrer and food marker, having at its upper end and flush therewith a platelet, a clip extending from a length portion of the pick proper, and terminating in a pointed end.

U.S. Pat. No. De. 149,499 (Holden); U.S. Pat. No. De. 323,598 (Rosenbaum); U.S. Pat. No. 2,079,193 (Wigen); U.S. Pat. No. 2,625,760 (Cleal), are cited as being of general interest.

None of the above cited references appears to be relevant in light of our disclosure, which shall now be described in detail.

SUMMARY OF THE INVENTION

In addition to what is stated under (d) above, our invention refers to a drink mixer device, comprising a smooth straight member having a widening upper front portion which forms a descriptive, humorous or ornamental top, such as a human face, a tennis racket, a silver dollar imitation, etc., capped by a plaque or platelet extending crosswise and right angularly to the straight portion of the device; the platelet terminates rear and downwardly in legs, attachable to the rim of a glass. The upper surface of the platelet has impressed thereon, e.g., the actual name, or humorous title of a person for whom a particular drink is intended so that he will be able to locate or identify his drink. The lower end of the stick portion of the device terminates in a broadening base, in the form of an ornamental configuration, e.g., a fish extending substantially parallel with the name identifying platelet; the functional purpose of the broadening base of the device is to provide—in conjunction with the widening top portion, and the platelet with attaching legs of same—a stabilizing effect on the device, so that it will not slide along the rim of a glass in the hand of the user and, thus interfere with the imbibing of the drink; furthermore, the broadening base of the stick provides an efficient mixing implement.

It is, therefore one object of the invention to provide a mixing device for drinks, which will easily identify, at convenient reading level, the person for whom the drink is intended.

It is still a further object to form functional parts of the device as ornamental, humorous or descriptive configurations.

It is a further object of the invention to provide means for stationary attachment of the mixer device onto the rim of a glass.

Additional advantages of our invention will appear from the following description thereof.

BRIEF DESCRIPTION OF THE DRAWINGS

FIG. 1 is a perspective front view of one embodiment of the invented mixer device.

FIG. 2 is a side-rear perspective view of the device of FIG. 1.

FIG. 3 is a perspective rear view of the device of FIG. 1.

FIG. 4 is a top view of the device of FIG. 1.

FIGS. 5*a, b, c* and *d* illustrate basically the device of FIG. 1, however provided with different configurations.

DESCRIPTION OF THE INVENTION

Like reference numerals in the different views of the drawings designate similar parts of the device.

Numeral 10 (FIG. 1) indicates a drink mixer according to the invention, having an elongated member 12, the lower end of which terminates integrally in the actual mixing agent or implement 14, in the form of a broadening base contoured as a decorative or appropriate shape, e.g., a fish 22, an open book 24*a* (for a college graduate), a tennis ball 26*a*, a boat 28*a*, or a football 30*a* (FIGS. 1 and 5*a, b, c* and *d*).

The conventional type drink mixer—in contrast to the invented mixer—consists substantially of a pointed or straight stick and, therefore is not an effective implement for stirring the content of a drink; apart from its decorative appearance, mixing implement 14, by virtue of its extending crosswise to member 12, thus constitutes an excellent means for preparing a well mixed drink.

The upper end of member 12, has a widening top portion 16, which suitably "go together" with the contoured form of mixing implement 14, e.g., depicting a smiling face (FIG. 1), or a graduate cap 24, a tennis racket 26, a globe 28 and a football cap 30 (FIGS. 5*a, b, c* and *d*); in preparing for a party, one may then choose the most appropriate configuration for the occasion, such as for a tennis club, graduation party, etc.

The upper edge of top portion 16 extends right-angularly rearward therefrom into an identifying plaque or platelet 18, which, when device 10 is attached to a drink, will lie horizontally on top of the rim of the glass, as indicated in FIG. 2.

The primary purposes of platelet 18 is to offer a means for identifying the person for whom a drink is intended, for hygienic reasons, or to ensure that that person will retain his chosen drink. The identifying platelet may spell out the name of a person, or a humorous title given to that person for the occasion, such as "king", "head shrinker", etc.; such names may be preprinted on platelet 18, or the latter may constitute an impressible surface, on which any selected indicia may be written in.

Portions of the rear free edge of platelet 18 extends substantially rightangularly downward therefrom into two legs 20 (FIG. 2), which are disposed spatially apart.

Before and after device 10 has been applied as a mixer for a drink, it is placed astride the edge of the glass, i.e., the edge being inserted between the narrow space formed between the rear surfaces of legs 20 and top portion 16; platelet 18 is then resting horizontally on the top of the edge of the glass, and thus placed at easy reading level for guests at parties.

The mixer, or at least its legs 20 are preferably made of resilient plastic material, so as to accommodate variable thicknesses and shapes of glasses.

The length of legs 20, may be such that device 10, when e.g., too long for the height of a glass, can still be attached thereto. FIG. 5*b* shows the legs 20 extending approximately along the length of contoured top 26.

The fact that the rim of a glass may be pressed resiliently between legs 20 and the back surface of top portion 16, in combination with broadening mixing means 14, will cause the device to resist sliding along the rim, when the glass is turned in the hand of a guest.

While the foregoing has illustrated and described what is now contemplated to be the best mode of carrying out the invention, the above embodiments of my invention are, of course, subject to modifications without departing from the spirit and scope of the invention. Therefore, it is not desired to restrict the invention to the particular constructions illustrated and described but to cover all modifications, that may fall within the scope of the appended claims.

We claim:

1. In a drink identifying mixer device for a drinking glass, comprising a longitudinal flush member, having a broadening end, respectively top portion, disposed coplanarly with the member, the end portion being operable as a drink mixing implement, and the top portion of the member extends right angularly rearward into a name identifying platelet, the upper surface of which being susceptible to impression of handmade or printed indicia thereon, and downwardly therefrom terminating in two legs for attachment in cooperation with the top portion and platelet of the device, onto the rim of the drinking glass, so that the name identifying surface portion of the platelet will rest on and along the rim surface of the drinking glass for easy visuality of the name identifying platelet surface.

2. A drink identifying mixer device, according to claim 1, wherein the broadening base and top portions are contoured to resemble matching objects such as a football, tennis ball, and the like, respectively a football helmet, tennis racket and the like.

3. A drink identifying mixer device, according to claim 1, wherein the legs extend resiliently and downwardly spatially apart from the platelet.

4. A drink identifying mixer device, according to claim 3, wherein the length of the legs are at least that of the top portions of the device, in order to accommodate widely varying heights of drinking glasses.

* * * * *